US007134893B1

(12) United States Patent
Kalisz et al.

(10) Patent No.: US 7,134,893 B1
(45) Date of Patent: Nov. 14, 2006

(54) PULL-LOCK TERMINAL CONNECTION SYSTEM

(75) Inventors: Joseph Paul Kalisz, Plymouth, MI (US); James Leroy Jones, III, Bellville, MI (US); James Dickinson Roberts, Royal Oak, MI (US)

(73) Assignee: Yazaki North America, Inc., Canton, MI (US)

( * ) Notice: Subject to any disclaimer, the term of this patent is extended or adjusted under 35 U.S.C. 154(b) by 0 days.

(21) Appl. No.: 11/386,723

(22) Filed: Mar. 23, 2006

(51) Int. Cl.
*H01R 13/28* (2006.01)
*H01R 25/00* (2006.01)

(52) U.S. Cl. ..... 439/287; 439/850

(58) Field of Classification Search ..... 439/287, 439/825, 775, 850
See application file for complete search history.

(56) References Cited

U.S. PATENT DOCUMENTS

| | | | |
|---|---|---|---|
| 2,497,523 | A | 2/1950 | Warkentin |
| 2,523,465 | A | 9/1950 | Graham |
| 2,615,736 | A | 10/1952 | Bergan et al. |
| 2,713,154 | A | 7/1955 | Bilsborough |
| 3,419,843 | A | 12/1968 | Hays |
| 3,471,823 | A | 10/1969 | Renshaw, Jr. |
| 3,516,043 | A | 6/1970 | Spofford |
| 4,199,208 | A | 4/1980 | Hawkins |
| 5,558,531 | A | 9/1996 | Ikeda et al. |
| 6,457,988 | B1 | 10/2002 | Andersen |

*Primary Examiner*—Javaid H. Nasri
(74) *Attorney, Agent, or Firm*—Daniel R. Edelbrock

(57) ABSTRACT

An electrical terminal connection system has a first terminal for attachment to a high-current cable. The first terminal is formed to include a wire-connect section for direct attachment to the wire and an intermediate stem section joining the wire-connect section to a contact section. The contact section has two opposite sides and deflectable arms extending along each side in parallel relation to each other. The arms are raised from the contact section and extend to free ends adjacent to an end of the contact section. A second terminal extends from a device-side of the connection, such as from a power distribution module (PDM). The second terminal has an initial seating section joined to a bus bar extending from within the PDM and a retaining section having two opposite edges. A short wall extends perpendicularly from each edge of the retaining section and a ledge extends from a top of each wall to overhang part of the retaining section. Each ledge has a portion slanted toward the seating section. When the contact section of the first terminal is placed on the initial seating section of the second terminal and pulled toward the retaining section of the second terminal, the deflectable arms flex and slide under the ledges until they interlock with the ledges behind the slanted portions. A releasable latch projection and stop tabs on the retaining section of the second terminal then prevent further movement of the first terminal in either direction.

20 Claims, 6 Drawing Sheets

PULL-LOCK TERMINAL CONNECTION SYSTEM

BACKGROUND OF THE INVENTION

1. Field of the Invention

The invention relates in general to the connection of electrical terminals and more particularly to high power terminals that are interlocked by pulling one terminal in a sliding motion against another terminal.

2. Discussion of Related Art

A power distribution center or module (PDM) consolidates fuses, branch circuits, relays, connectors and other electrical components in a single location within a vehicle. The PDM often includes a mounting surface having a plurality of receptacles for receiving the electrical components. A bus bar is routed beneath the surface and has a plurality of blade-like projections that protrude into some or all of the receptacles to make electrical contact with the components. The bus bar is used to supply electrical power to the components for serving the vehicle electrical circuit requirements. The electrical power is usually provided to the bus bar through a high power cable from the vehicle alternator and/or battery.

Often, in high power connections, an eyelet terminal is crimped on the end of the high current cable. The eyelet terminal fits over a threaded stud extending through the bus bar in the PDM, and a nut is used to tighten the eyelet terminal into electrical connection with the bus bar. Alternatively, a separate bolt and nut could be used to secure the terminal to the bus bar. Either way, retention features of these types increase labor costs because they requires tools, often with torque monitoring capabilities, to fasten the terminal to the bus bar. This provides the opportunities for cross-threading or improperly torqued attachments that could cause loose attachments. Inadequately tightened connections in turn could lead to electrical arcing, overheating, loss of contact and other undesirable events.

U.S. Pat. No. 7,077,711 discloses one way of eliminating the need for threaded studs, bolts and nuts to make such electrical connections. A manually operated lever on the PDM is used to rotate a cam surface against a harness terminal. This forces the harness terminal against a bus bar extending from the PDC. The design of the cam surface along with a latch for the lever act to hold the terminal against the bus bar. Though no threaded fasteners or tools are required, this approach requires a mechanical device in addition to the terminals.

Self-locking connectors, such as the one disclosed in U.S. Pat. No. 5,586,898, are often complex and bulky, and usually need to be manufactured from more than one material. Hermaphroditic terminals for electrically connecting wire harnesses are also well known in the art. They are simpler and less expensive then self-locking connectors, and do not require the use of additional fasteners. Such terminals eliminate the need for having to match terminals with distinctly male and female characteristics. However, with PDM bus bar and high power cable terminal connections, it is not practical for the bus terminal and cable terminal to have identical features.

SUMMARY OF THE INVENTION

Accordingly, it is an object of this invention to allow connection of high power terminals without the use of fastening devices, manual or power tools, or other added mechanisms.

Another object of the invention is to enable the terminals to interlock and provide a required electrical contact force simply by pulling one terminal in a sliding motion against another terminal.

A further object of the invention is to reliably maintain the electrical connection with integral features of the terminals.

In carrying out this invention in the illustrative embodiment thereof, a first terminal has a wire-connect section for direct electrical and mechanical attachment to the high power cable, and an intermediate stem section joining the wire-connect section with a contact section. The contact section has a first end integral with the intermediate section, and a central member with two opposite sides. Parallel, deflectable arms extend from the first end along each side to a second end of the contact section. The deflectable arms have successive segments, including a segment fixed to the first end and rising above a main plane of the contact section to an apex, and a shorter, declined segment sloping from the apex to the second end of the contact section. An aperture is positioned in the contact section between the arms.

A second terminal is formed on an extension of a bus bar from, for example, a power distribution module (PDM). The second terminal has a substantially flat initial seating section integral with the bus bar and leading to a retaining section. The retaining section has a first end joined to the seating section, a second, free end, and two opposite edges. A short wall extends upward at a right angle from each edge. A ledge projects from a top of each wall to overhang part of the retaining section. Each ledge includes a portion slanted or declined toward a plane of the terminal adjacent to where the seating and retaining sections join. A spring latch protrudes upward from a plane of the terminal in a central area of the retaining section between the ledges. The second end of the retaining section has two up-turned tabs spaced across a width of the retaining section.

In operation, the contact section of the first terminal is placed on the initial seating section of the second terminal with the stem and wire-connect sections positioned between the ledges and up-turned tabs of the retaining section. The first terminal is pulled away from the PDM. The declined portions of the ledges on the second terminal act against the inclined segments of the deflectable arms of the first terminal to push the arms toward the main plane of the first terminal. The arms flex back or upward when the declined segments of the arms move behind the declined portions of the ledges. The arms are then interlocked with the ledges. Simultaneously, the spring latch of the second terminal snaps into the aperture in the first terminal and the first end of the contact section of the first terminal abuts against the up-turned tabs of the second terminal. This prevents further sliding movement in either direction until the spring latch is manually depressed or released.

This design allows the terminal attached to the cable to be placed over the bus-side terminal and then be simply pulled back to engage the interlock features and lock the terminals together. The system allows high power terminals to be connected together without the use of fasteners and tools, thus saving system and labor costs and increasing connection reliability.

BRIEF DESCRIPTION OF THE DRAWINGS

This invention, together with other objects, features, aspects and advantages thereof, will be more clearly understood from the following description, considered in conjunction with the accompanying drawings.

DETAILED DESCRIPTION OF THE ILLUSTRATED EMBODIMENT

Figure 1:
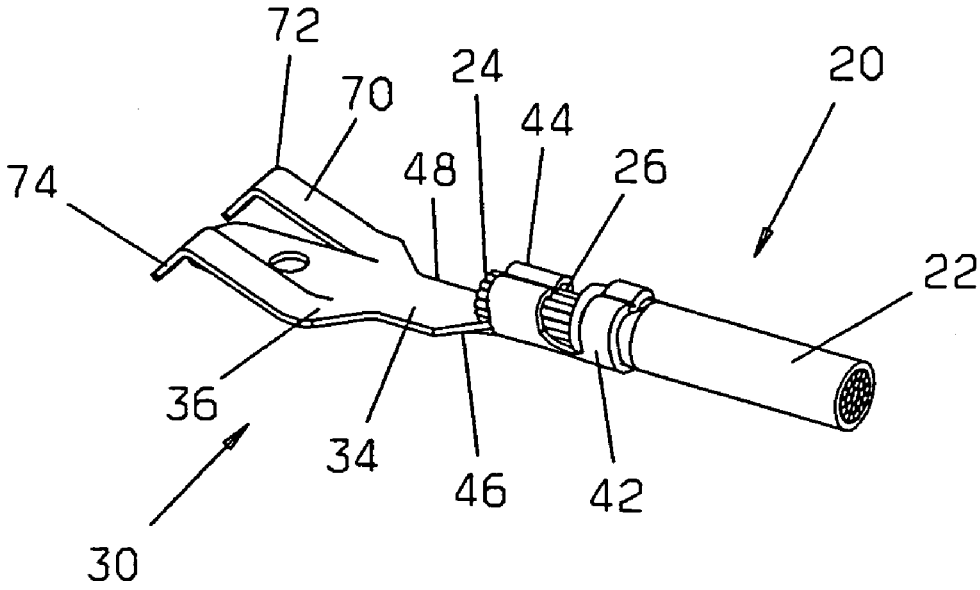
FIG. 1 is an isometric view of a first or cable-side terminal of a connector or electrical connection system according to the present invention.
Figure 2:
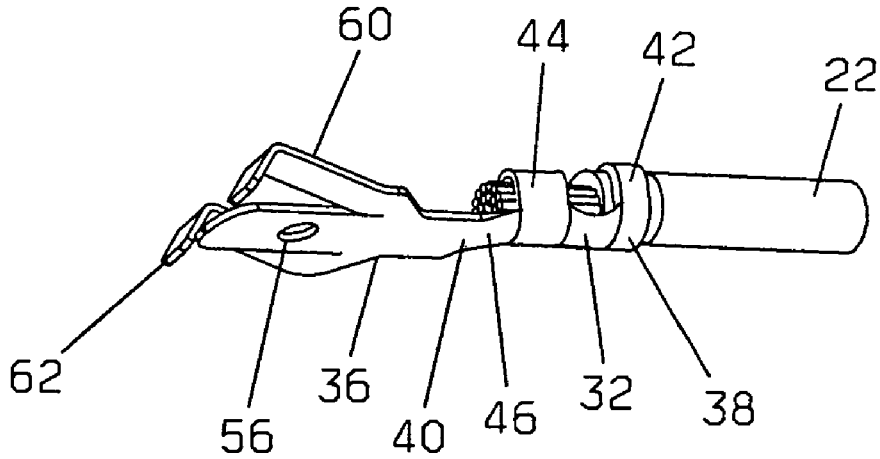
FIG. 2 is an isometric underside view of the cable-side terminal.

Referring now to FIGS. 1–4, a first, cable-side terminal of an electrical connection system according to the present invention is illustrated. The first terminal is designed for attachment to a high power wire harness or electrical cable 20. The cable depicted is used as an example and includes an outer insulation jacket 22 surrounding multiple inner conductors 24. The inner conductors 24 are exposed at a stripped end 26 of the cable.

The first or cable-side terminal 30 has a first, wire-connect section 32, and a second, intermediate or stem section 34 joining the wire-connect section to a third, contact section 36. The wire-connect section 32 has an end 38 distal from the stem section 34 and an opposite end 40 joining the wire-connect section to the stem section. The end 38 has tabs 42 for crimping around the insulation jacket 22 of the cable 20 to physically secure the terminal to the cable. Additional tabs 44 between the tabs 42 and the opposite end 40 of the wire-connect section are used for crimping around the exposed conductors 24 of the cable to electrically connect the terminal to the cable. The wire-connect section has a short, sloped or angled portion 46 between the tabs 44 and the end 40 that unites with the stem section 34. The stem section 34 is generally flat and rectangular with two parallel, spaced apart sides 48. A width of the stem section defined between the sides 48 is narrower than a total width of the contact section 36.

Figure 3:
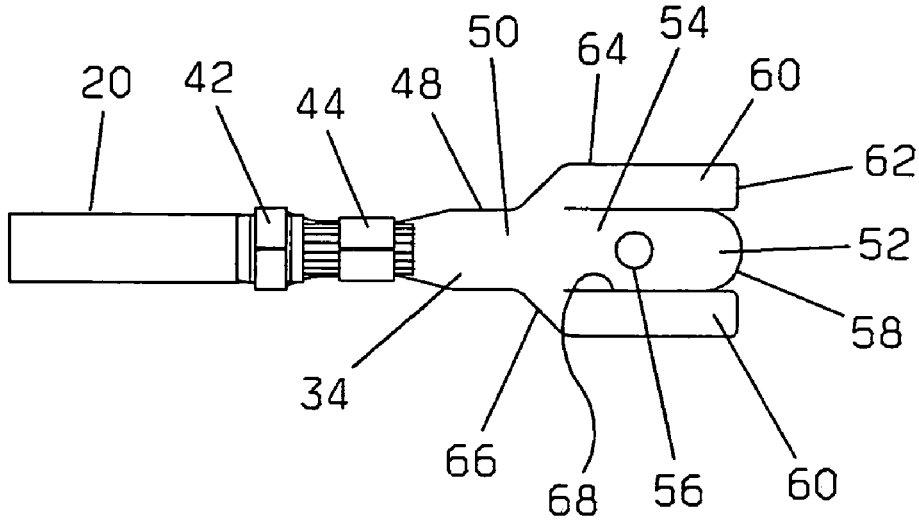
FIG. 3 is a top view of the cable-side terminal.
Figure 4:
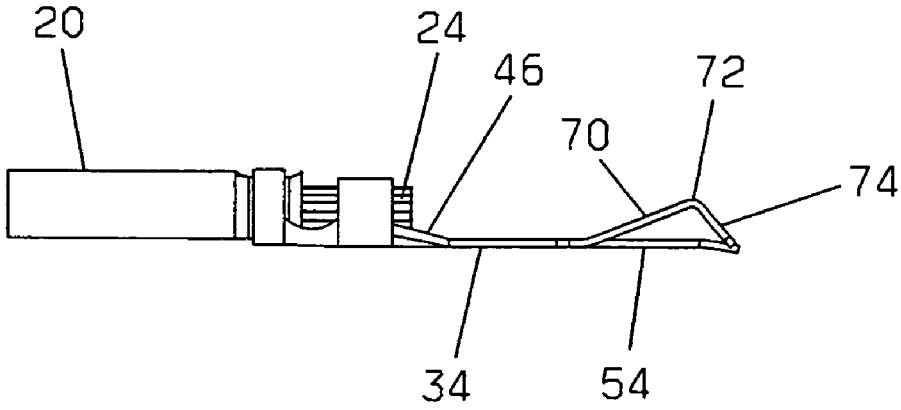
FIG. 4 is a side view of the cable-side terminal.

The contact section 36 has a first end 50 (FIG. 3) integrally joined with the stem section 34 and a second end 52 distal from the stem section. The second end 52 is part of a central appendage or member 54. The member 54 has an aperture 56 located in a central area of its width, a little closer to the first end 50 than the second end 52. The member 54 is generally rectangular and flat, except for adjacent the end 52, where it has a rounded perimeter 58, as best shown in FIG. 3, and is slightly down-turned relative to a focal plane of the member 54 and stem section 34, as depicted in FIG. 4. The width of the member 54 is approximately equal to the width of the stem section 34.

The central member 54 extends between, and in the same direction as, two outer, resilient, deflectable, bent arms 60 that form two sides of the contact section 36. The arms 60 extend along substantially an entire length of the contact section 36 from the first end 50, and are parallel to each other and separated across a width of the contact section by the member 54. The arms 60 are cantilevered from the first end 50 of the contact section 36 and have free ends 62 adjacent to the second end 52 of the member 54.

The arms 60 have outer edges 64 that are parallel and merge into tapered edges 66 of the first end 50 of the contact section. The tapered edges 66 converge with the sides 48 of the narrower stem section 34. Inner edges 68 of each arm 60 are parallel along the entire length of the arms. Each arm 60 has two segments. A first, longer segment 70 lifts or inclines from the first end 50 of the contact section 36 and the focal plane of the member 54 to a peak or apex 72. A second, shorter segment 74 declines or slopes back to the plane of the member 54 from the apex 72 to the free end 62 of the arm.

The second terminal of the electrical connection system is illustrated in FIGS. 5–9. This terminal is a device-side or bus-side terminal. For purposes of example, it is illustrated as being formed on the end of a lead-frame or bus bar 80 that could extend from within a power distribution module (PDM) or other electrical appliance or device. When used with a PDM, for example, the bus bar 80 would distribute power to various electrical circuits served by the PDM. The bus bar has a main part 82 and two branching parts 84. The branching parts 84 have outer extremities with down-turned, right-angle ends forming blades or prongs 86.

The second terminal 90 has a first, substantially flat, initial seating section 92 integral with the main part 82 of the bus bar 80. The flat or seating section 92 is slightly narrower in width than the contact section 36 of the first terminal 30. A second, retaining section 94 has a first end 96 integrally joined to the initial seating section 92 and a second, distal end 98. The first end 96 provides a stepped increase in width from the seating section 92 to make the retaining section 94 substantially equal in width to the contact section 36 of the first terminal 30. The width of the retaining section 94 is defined by outer, parallel opposite edges 100.

The retaining section 94 of the bus-side terminal 90 has features configured and arranged to interlock with the contact section 36 of the cable-side terminal 30. A short wall 102 extends upward from each edge 100 perpendicular to a main plane of the bus-side terminal. Each wall has a top or upper surface from which a shelf or ledge 104 extends at a right angle to overhang part of the retaining section. The ledges 104 are approximately equal in width to the width of the arms 60 of the contact section 36 of the cable-side terminal 30, leaving an open space between the ledges across the width of the retaining section 94. Each ledge has a contiguous, downward-slanting or declined portion 106 that is separated from the wall 102 and projects toward the initial seating section 92. A curved end portion 108 forms a slightly up-turned end on the declined portion 106 near and just above the seating section 92. The declined portions and curved end portions provide resilient elements to the ledges 104 immediately adjacent the seating section 92, constricting entrances adjacent the seating section to slots or passages 110 formed under the ledges.

Figure 6:
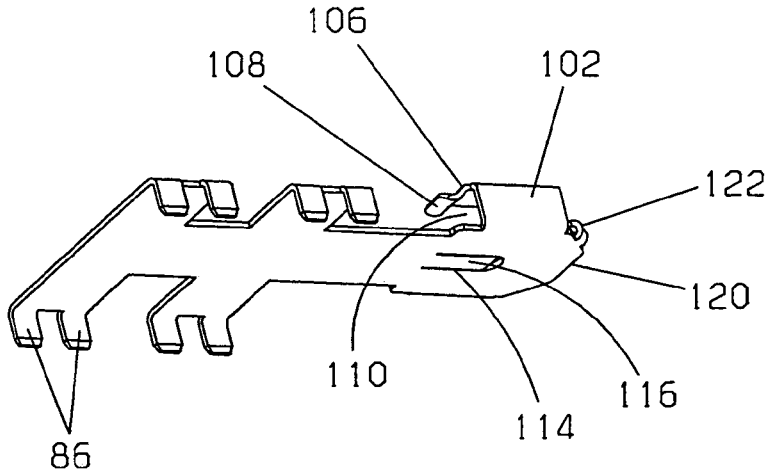
FIG. 6 is an isometric underside view of the bus bar and bus-side terminal.
Figure 7:
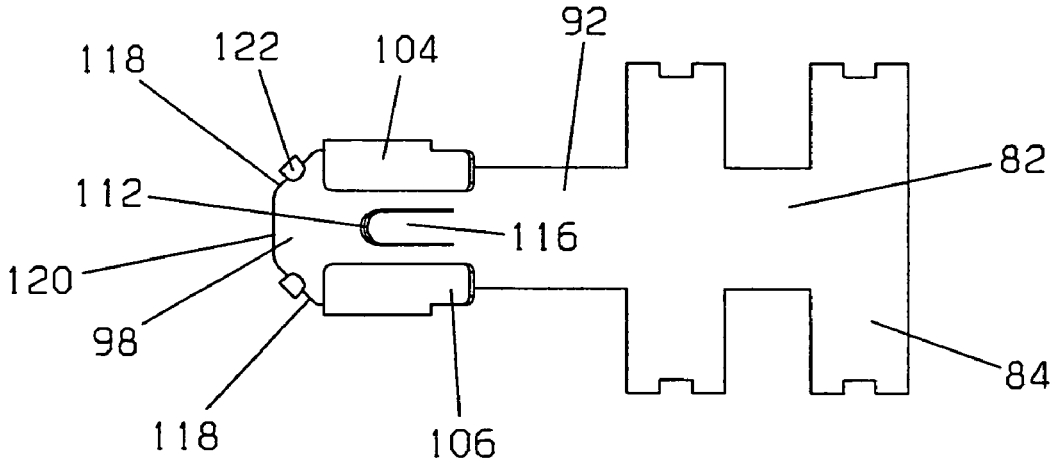
FIG. 7 is a top view of the bus bar and bus-side terminal.
Figure 8:
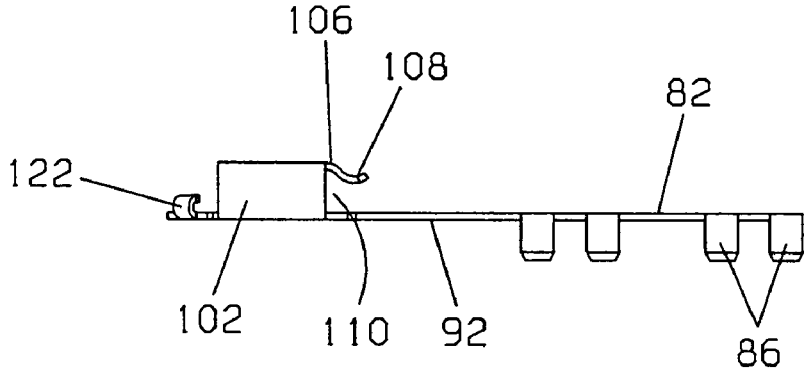
FIG. 8 is a side view of the bus bar and bus-side terminal.
Figure 9:
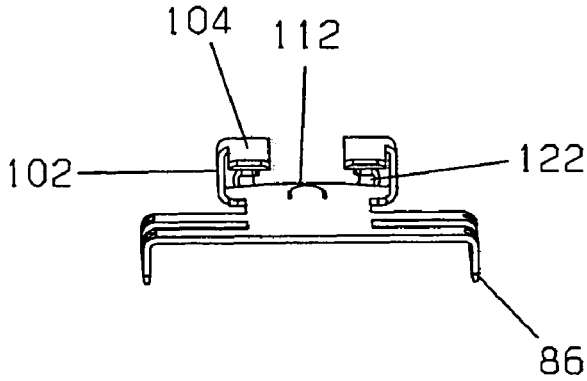
FIG. 9 is an elevated end view of the bus-side terminal looking along the terminal from the bus bar.

A spring or latch projection 112 with a rounded end part protrudes upward from the main plane of the retaining section 94 between the ledges 104 in a central area of the retaining section, as best illustrated in FIGS. 6, 7 and 9. The projection is formed by making a semi-circular cut 114 (FIG.

6) in the retaining section 94 and bending the material such that a rectangular-shaped body part 116 of the projection (FIG. 7) integral with the retaining section extends in the direction of the first end 96 of the retaining section and the seating section 92. The rounded end part of the projection 112 slopes in the direction of the second end 98.

Figure 5:
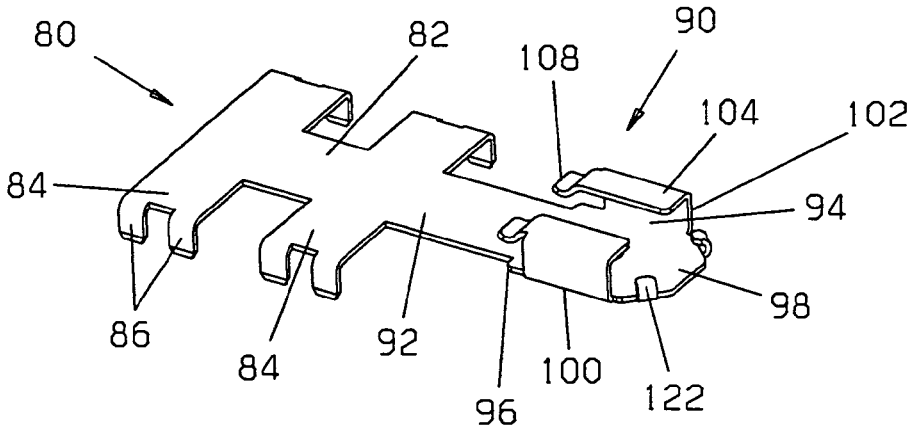
FIG. 5 is an isometric view of a bus bar and second or bus-side terminal of the connector or electrical connection system according to the present invention.

As depicted in FIGS. 5 and 7, the second end 98 of the retaining section 94 is three-sided. Two sides 118 converge from the opposite edges 100 adjacent the ledges 104 to a forward side 120. Two up-turned stop tabs 122, each projecting from an approximate middle of a side 118, are bent to hang or loom over an upper surface of second end 98 in a hook-shaped arrangement.

Figure 10:
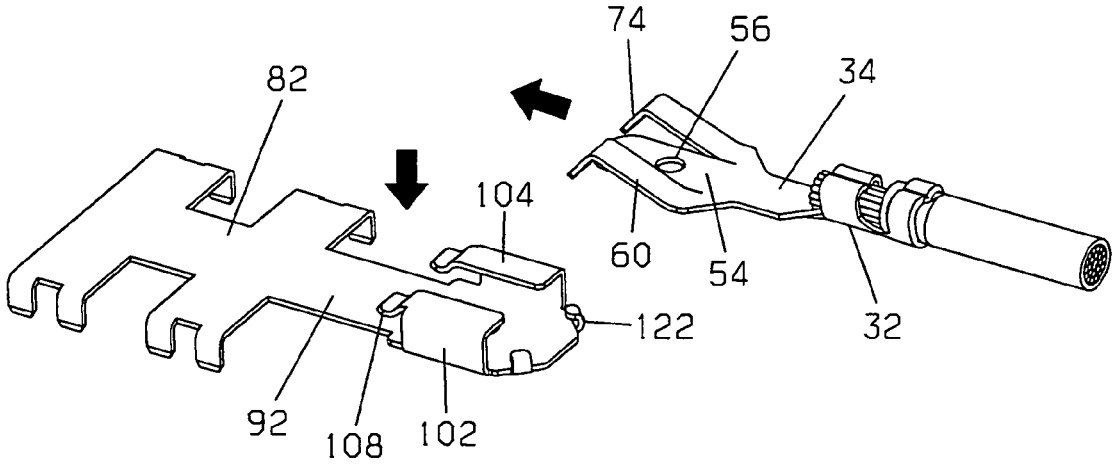
FIG. 10 is an exploded isometric view of the cable-side terminal and bus-side terminal aligned prior to assembly.
Figure 11:
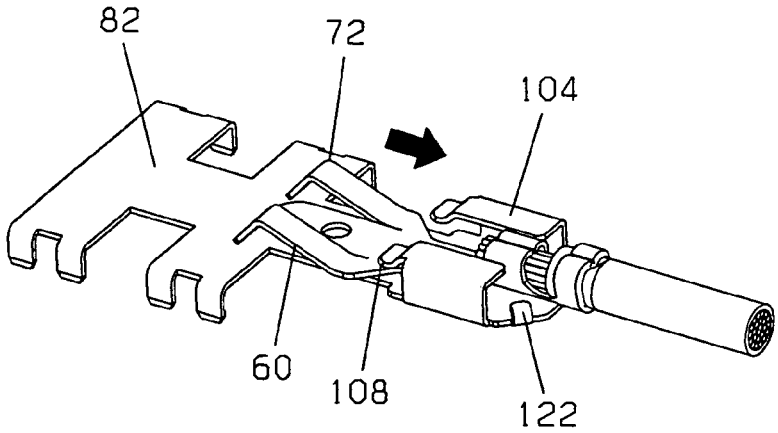
FIG. 11 is an isometric view of the terminals in an initially engaged, unlocked arrangement.

To make the electrical connection between the electrical cable and the bus bar, the contact section 36 of the cable-side terminal 30 is rested or seated on the initial seating section 92 of the bus-side terminal 90, as demonstrated in FIGS. 10 and 11. The widths of the stem section 34 and wire-connect section 32 of the cable-side terminal are narrow enough to fit between the ledges 104 and up-turned stop tabs 122 of the retaining section 94 of the bus-side terminal. The latch projection 112 is flexed downward toward the main plane of the retaining section 94 under the stem section 34 of the first terminal.

Figure 12:
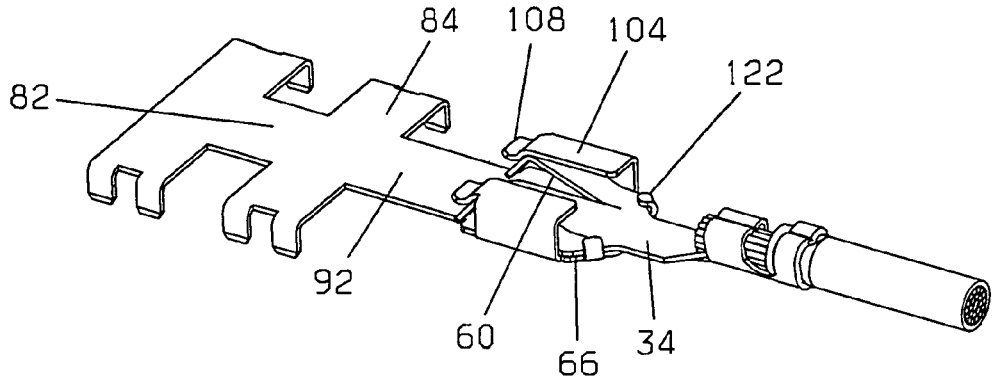
FIG. 12 is an isometric view of the terminals in a fully assembled, locked arrangement.

The cable-side terminal 30 is then pulled in a direction away from the bus bar 80, sliding the contact section 36 toward the retaining section 94. The up-turned curved end portions 108 of the ledges 104 contact the first segments 70 of the deflectable arms 60 in a smooth, sliding manner. The arms are readily pressed downward toward the focal plane of the terminal 30. This continues until the apexes 72 of the arms 60 pass under the curved end portions 108 of the ledges 104. At this point, the arms 60 flex upward such that the declined segments 74 of the arms slide against undersides of the declined portions 106 of the ledges, as shown in FIG. 12. When the apex 72 of each arm 60 passes a tangent point formed where the curved end portion 108 meets the declined portion 106 of each ledge, the spring forces between the arms and ledges will assist continued mating of the terminals by applying force to the angled contact surfaces. This is often called inertial assist. Eventually, the apexes 72 contact undersides of the ledges 104 and the declined segments 74 of the arms remain pressed against the portions 106 of the ledges. The spring characteristics of the arms 60 maintain the contact with the ledges within the slots or passages 110, and also force the contact section 32 against the retaining section 94.

Simultaneously, the rounded end part of the spring projection 112 snaps upward to be received in the aperture 56 of the member 54 with an audible click. This provides a latch or lock that prevents reverse movement of the contact section 36 of the cable-side terminal toward the seating section 92 of the bus-side terminal. At approximately the same time, the tapered edges 66 of the first end 50 of the contact section 36 of the cable-side terminal slide under and abut against the stop tabs 122 on the bus-side terminal, preventing further forward or pulling movement. The two terminals are therefore securely interlocked in reliable electrical connection.

To separate the terminals and break the electrical connection, a narrow pin, screwdriver or other tool is used to fit between the ledges 104 and depress the spring projection 112 back toward the main plane of the bus-side terminal 90 until it exits the aperture 56. Then the cable-side terminal 30 can be pushed toward the seating section 92 of the bus-side terminal 90. The arms 60 are again deflected downward toward the focal plane of the terminal 30 by the declined portions 106 of the ledges 104 until the arms exit the passages 110. The cable-side terminal can then be lifted off the bus-side terminal.

The connection of the terminals in this manner provides visual, audible and tactile feedback to the assembler. The connection operation can be performed single-handed and reduces overall labor time and cost. The terminals can be formed relatively easily. They could be stamped, cut, and bent or otherwise manufactured from a copper alloy or brass in stock of at least 0.8 mm thickness, for example, and then tin-plated. The second terminal 90 can be formed on an extension of the bus bar 80 that might otherwise be removed as scrap. The terminals can be stamped for substantially the same tooling and material cost as a conventional eyelet terminal, and replace the eyelet terminal, stud and nut. The terminal connection system according to the present invention provides an assembly or connector that could be used in various environments, such as with vehicle starters, alternators, motors or actuators with lead-frames, battery terminals and grounding connections. The second terminal 90 could be used with another wire harness for a cable-to-cable connection.

Figure 13:
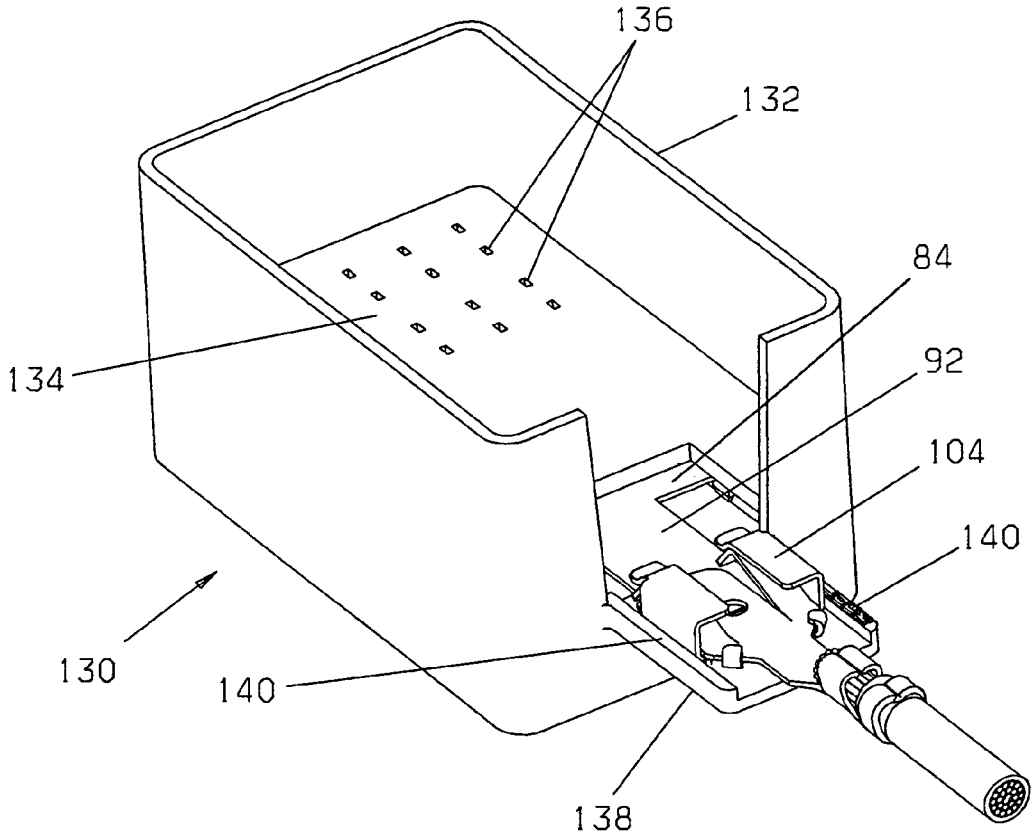
FIG. 13 is a perspective view of the assembled terminals as used with a power distribution module.

As an example, FIG. 13 illustrates the terminal connection system as used with a PDM 130. The PDM has an outer housing 132 surrounding a horizontal mounting surface 134 for electrical components (not shown) such as relays and fuses. Receptacles 136 in the mounting surface 134 guide contacts from the electrical components into electrical connection with the prongs 86 of the bus bar 80 under the mounting surface. An integral plate or platform 138 extends outward from the housing 132 for supporting the terminal connection. The platform has outer rails 140 that add structural stability, prevent significant side-to-side movement of the bus-side terminal, and help insulate the connection. If required, the assembled terminals can be covered and protected by a non-conductive cap tethered to the PDM, or by an extended part of a conventional PDM cover.

Since minor changes and modifications varied to fit particular operating requirements and environments will be understood by those skilled in the art, this invention is not considered limited to the specific examples chosen for purposes of illustration. The invention is meant to include all changes and modifications which do not constitute a departure from the true spirit and scope of this invention as claimed in the following claims and as represented by reasonable equivalents to the claimed elements.

What is claimed is:

1. An assembly for connecting an electrical cable to a device, the assembly comprising:

a first terminal having a wire-connect section joined to a first end of a contact section, the contact section having a length and two deflectable arms extending from the first end along the length to a second end of the contact section, the contact section further including a central member extending along the length, the arms being spaced across the central member, each deflectable arm having an inclined segment rising away from a plane of the central member to an apex and a declined segment sloping back toward the plane from the apex; and a second terminal having means for interlocking with the deflectable arms of the first terminal.

2. The assembly of claim 1 wherein the interlocking means are spaced apart across a width of the second terminal.

3. The assembly of claim 2 wherein each interlocking means includes a slot for receiving one of the deflectable arms.

4. The assembly of claim 1 wherein the second terminal comprises a flat section and a retaining section extending from the flat section, the retaining section having a first end joining the retaining section to the flat section, a second end distal from the flat section, and two opposite edges, and wherein the interlocking means are located adjacent each edge of the retaining section.

5. The assembly of claim 4 wherein the interlocking means each comprise a wall extending perpendicularly from each edge of the retaining section, and a ledge protruding from each wall to overhang part of the retaining section.

6. The assembly of claim 5 wherein each ledge has a portion slanted toward the flat section.

7. The assembly of claim 6 further comprising an up-turned curved end portion contiguous with the slanted portion and extending toward and spaced above the flat section.

8. The assembly of claim 4 further comprising an aperture in the central member of the first terminal and a latch projection in the retaining section of the second terminal positioned for receipt in the aperture when the interlocking means of the second terminal interlock with the deflectable arms of the first terminal.

9. The assembly of claim 4 further comprising at least one tab on the second end of the retaining section for stopping movement of the first terminal when the interlocking means of the second terminal interlocks with the deflectable arms of the first terminal.

10. An electrical connector comprising:

a first terminal for attachment to an electrical cable;

a second terminal having a first section for electrical attachment to a device, and a second section extending from the first section, the second section having a first end joined to the first section, a second, free end, two opposite edges, a short wall extending at a right angle from each edge, and a ledge projecting from a top of each wall to overhang part of the second section and form a passage, each ledge having a portion declined toward the first section; and the first terminal further including resilient means for sliding under the declined portions into the passages formed by the ledges of the second terminal.

11. The connector of claim 10 wherein the resilient means of the first terminal comprise parallel, deflectable arms spaced across a width of the first terminal to slide between the walls under the declined portions of the ledges and maintain contact with the ledges.

12. The connector of claim 11 wherein the deflectable arms each have an inclined segment which is forced toward a plane of the first terminal by the declined portion of the ledge until the inclined segment passes the declined portion.

13. The connector of claim 12 wherein the deflectable arms extend from a first end of the first terminal attached to the cable to a second, free end, the inclined segments of the arms each reaching an apex, each arm further including a segment sloping from the apex to the free end of the first terminal.

14. The connector of claim 10 further comprising an aperture in the first terminal and a spring latch in the second section of the second terminal between the ledges, the spring latch being positioned such that the latch is received in the aperture when the resilient means of the first terminal are in the passages of the second terminal.

15. The connector of claim 10 further comprising at least one stop tab formed adjacent the second end of the second terminal for acting against the first terminal to prevent further movement when the resilient means of the first terminal are in the passages of the second terminal.

16. An electrical terminal connection system comprising:

a first terminal having a contact section joined to a wire-connect section by an intermediate section, the contact section having a first end adjacent the intermediate section, a second end, two opposite sides extending between the ends, and deflectable arms, each arm cantilevered from the first end and extending parallel to one of the sides, the arms having free ends near the second end of the contact section, the contact section further including an aperture approximately midway between the sides; and a second terminal having a flat section and a retaining section extending from the flat section, the retaining section having two, opposite edges, and a wall extending perpendicularly from each edge of the retaining section, each wall having a ledge overhanging part of the retaining section, each ledge having a portion slanted toward the flat section, the retaining section further including a latch projection between the ledges;

wherein placing the contact section of the first terminal on the flat section of the second terminal and pulling the contact section toward the retaining section of the second terminal causes the arms to deflect against, slide under and then interlock with the slanted portions of the ledges as the latch is received in the aperture to prevent a reverse movement of the contact section toward the flat section.

17. The electrical terminal connection system of claim 16 wherein the retaining section has an end distal from the flat section, and further comprising at least one up-turned stop surface adjacent the end of the retaining section against which the first end of the contact section of the first terminal abuts when the latch projection is received in the aperture to prevent further movement of the contact section away from the flat section.

18. The electrical terminal connection system of claim 17 wherein there are two up-turned stop surfaces spaced apart a distance that enables the wire-connect section and intermediate section of the first terminal to slide between them when the contact section of the first terminal is pulled toward the retaining section of the second terminal.

19. The electrical terminal connection system of claim 18 wherein the first end of the contact section of the first terminal has tapered edges converging toward the intermediate section and each of the two up-turned stop surfaces adjacent the end of the retaining section of the second terminal are on a side converging toward the end from the opposite edges of the retaining section.

20. The electrical terminal connection system of claim 16 further comprising up-turned curved end portions contiguous with the slanted portions of the ledges to enable smooth sliding contact with the deflectable arms.

* * * * *